United States Patent [19]

Adachi et al.

[11] 4,381,476

[45] Apr. 26, 1983

[54] FLUORESCENT LAMP INSTANTANEOUS STARTING DEVICE

[75] Inventors: Hiromi Adachi; Kazunari Inoue; Hiroshi Ohshita, all of Kamakura, Japan

[73] Assignee: Mitsubishi Denki Kabushiki Kaisha, Tokyo, Japan

[21] Appl. No.: 217,076

[22] Filed: Dec. 16, 1980

[30] Foreign Application Priority Data

Dec. 20, 1979 [JP] Japan ..... 54-166035

[51] Int. Cl.[3] ..... H05B 39/00

[52] U.S. Cl. ..... 315/101; 315/209 SC; 315/243; 315/290; 315/DIG. 7

[58] Field of Search ..... 315/101, 209 SC, 224, 315/243, 290, DIG. 7; 307/313, 305

[56] References Cited

U.S. PATENT DOCUMENTS

| | | | |
|---|---|---|---|
| 2,462,306 | 2/1949 | Cook | 315/101 |
| 3,193,707 | 7/1965 | Yanai | 307/305 |
| 3,569,776 | 3/1971 | Moerkens | 315/243 |
| 3,836,816 | 9/1974 | Adrianus et al. | 315/101 |
| 3,914,646 | 10/1975 | Paupy | 315/101 |
| 4,015,167 | 3/1977 | Samuels | 315/101 |
| 4,050,083 | 9/1977 | Jaskolski | 305/305 |
| 4,119,886 | 10/1978 | Jyomura et al. | 315/101 |
| 4,119,887 | 10/1978 | Iyama et al. | 315/101 |

*Primary Examiner*—Harold A. Dixon

*Attorney, Agent, or Firm*—Sughrue, Mion, Zinn, Macpeak and Seas

[57] ABSTRACT

A fluorescent lamp starting device in which an electronic starter is provided in the form of a hybrid integrated circuit which is mounted in a standard glow starter case and which can be utilized in a standard glow starter socket of a fluorescent lamp fixture. A nonlinear capacitor and semiconductor switch are coupled in parallel with another and across the external terminals of the starter. The nonlinear capacitor is provided in the form of a thin plate while the semiconductor switch is provided on an IC substrate substantially equal in size to the nonlinear capacitor.

1 Claim, 8 Drawing Figures

FLUORESCENT LAMP INSTANTANEOUS STARTING DEVICE

BACKGROUND OF THE INVENTION

The present invention relates to a device for instantaneously starting a fluorescent lamp with a starter composed of a nonlinear capacitor and a semiconductor device. More particularly, the invention relates to fluorescent lamp starting device which can instantaneously start a fluorescent lamp and for which no modification of a conventional fluorescent lamp fixture is required.

A variety of techniques for starting a fluorescent lamp employing a glow starting system in which an electronic starter is provided in the glow starter socket of a fluorescent lamp fixture have been proposed in the art. However, these techniques have found practical application only for small wattage fluorescent lamps of 10 W (FL 10) or smaller and not for fluorescent lamps of 15 W (FL 15) or higher because the former can be started merely by applying the standard AC supply voltage, 115 V for instance, while about 600 V is necessary to start the latter or larger types.

FIG. 1 is a circuit diagram of a known type of electronic starter for a FL 10 fluorescent lamp. In FIG. 1, reference numeral 1 designates a bi-directional thyristor, 2 a diode, 3 a capacitor, 4 a fluorescent lamp, 5 filaments, and 6 a stabilizer. This circuit functions only to preheat the lamp filaments 5 and generates no high voltage pulses. Since the circuit is made up of only three components, it is small enough to be mounted in a glow starter case such as specified by JIS C 7603 (relating to fluorescent lamp glow starters).

As stated above, it is necessary to provide a pulse voltage of 600 V or higher to start a fluorescent lamp of 15 W or higher. Accordingly, an electronic starter should perform both a filament preheating function and a pulse generating function.

A variety of circuits have been employed for such an electronic starter. One known type of circuit is shown in FIG. 2 in which reference numeral 6 designates a stabilizer, 5 filaments, 2 a diode, 7 a choke coil with a ferrite core, 1 a bi-directional thyristor, 3*a* and 3*b* capacitors, and 8 a resistor. Typical ratings and sizes of these components are as indicated in Table 1 below:

TABLE 1

| Component | Rating | Size (mm) |
|---|---|---|
| Choke coil (7) | 200 mH | 19 × 17 × 17 |
| Capacitor (3a) | 0.68 μF 200VDC | 18 × 17 × 9 |
| Capacitor (3b) | 0.002 μF 1000VDC | 26 × 11 ϕ |

The diode 2 and the bi-directional thyristor 1 can be miniaturized by providing them in the form of a semiconductor chip and the resistor 8 also can be miniaturized by employing a thick film resistor. However, it is difficult using presently avilable techniques to miniaturize the choke coil 7 and the capacitors 3*a* and 3*b* listed in Table 1, and therefore, it is impossible to assemble the above-described components within the volume allowed for a glow starter. That is, the external size of an electronic starter for a fluorescent lamp of 15 W (FL 15) or higher is several times as larger as that of a glow starter which prevents the miniaturization and standardization of electronic starters.

SUMMARY OF THE INVENTION

Accordingly, an object of the invention is to provide a fluorescent lamp starting device which has external dimensions substantially equal to those of a glow starter even for a fluorescent lamp of FL 15 or higher and which can be connected directly to a glow starter socket.

Provided by the invention is a fluorescent lamp starting device in which an electronic starter is provided in the form of a hybrid integrated circuit employing a nonlinear capacitor and a semiconductor switch in combination. The components are arranged so that the external size of the device is substantially equal to that of a conventional glow starter whereby the device can be connected directly to a conventional glow starter socket.

The nature, principle and utility of the invention will become more apparent from the following detailed description when read in conjunction with the accompanying drawings.

DESCRIPTION OF THE PREFERRED EMBODIMENTS

Figure 1:
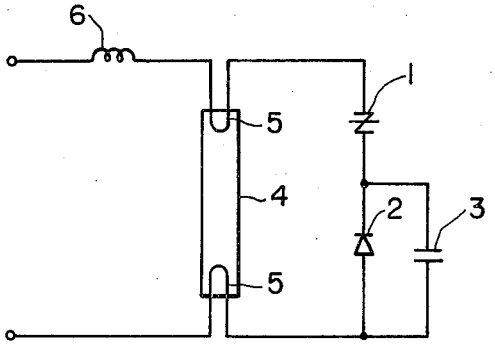
FIG. 1 PRIOR ART
FIG. 1 is a circuit diagram of a conventional electronic starter used for a fluorescent lamp of 10 W or lower.
Figure 2:
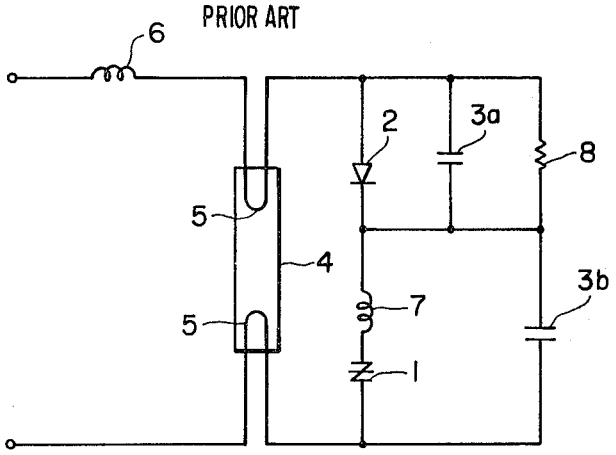
FIG. 2 PRIOR ART
FIG. 2 is a circuit diagram of a conventional electronic starter used for a fluorescent lamp of 15 W or higher.
Figure 3:
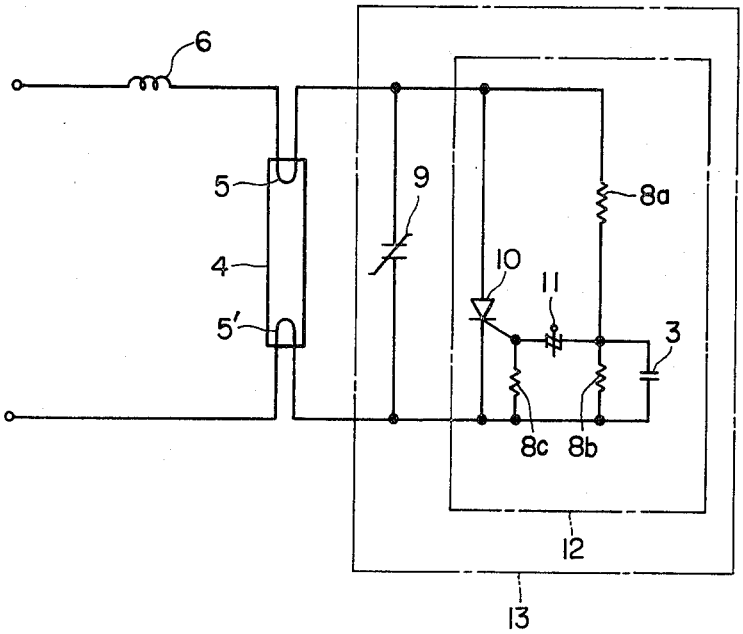
FIG. 3 PRIOR ART
FIG. 3 is a circuit diagram showing an electronic starter employing a nonlinear capacitor according to the invention.

FIG. 3 is a circuit diagram of an electronic starter of the invention which employs a nonlinear capacitor to instantaneously start a fluorescent lamp. The values and ratings of the components of a preferred embodiment of the electronic starter are indicated in Table 2 below:

TABLE 2

| Component | Rating | Component | Rating |
|---|---|---|---|
| Nonlinear capacitor (9) | | Resistor (8a) | 200KΩ 1/50W |
| Diode (2) | 1A 1000V | Resistor (8b) | 27KΩ 1/1000W |
| SCR (10) | 2A 600V | Resistor (8c) | 1KΩ 1/1000W |
| SBS (11) | 8V | | |
| Capacitor (3) | 47000pF 25V | | |

In FIG. 3, reference numeral 4 designates a fluorescent lamp having filaments 5 and 5' at both ends; 6 an inductive stabilizer; 12 a semiconductor switch including a reverse blocking triode thyristor 10, a trigger element 11 such as an SBS or a DIAC, voltage division gate circuit resistors 8*a* and 8*b*, a stabilizing resistor 8*c* and a smoothing capacitor 3; 9 a nonlinear capacitor; and 13 a lighting element including the semiconductor switch 12 and the nonlinear capacitor 9. Further in FIG. 3, reference characters U and V designate power source terminals.

Figure 4:
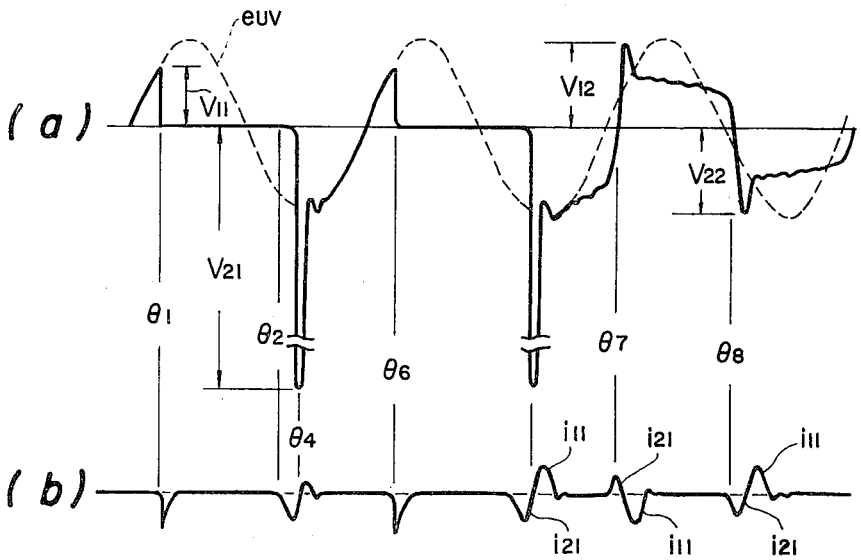
FIG. 4A is a waveform diagram showing a voltage across the terminals of a lamp in the circuit of FIG. 3.
FIG. 4B is also a waveform diagram showing charge and discharge currents through a nonlinear dielectric element.

With an AC voltage $e_{UV}$ as indicated by the dotted line in FIG. 4A is applied across the power source terminals U and V, in the initial start period, the thyristor 10 is turned on at a suitable phase $\theta_1$ of a positive half cycle of the AC voltage to thus permit current to flow through the stabilizer 6, the filament 5, the thyristor 10 and the filament 5' and thereby preheating the filaments 5 and 5'. After the preheating current has flowed, the thyristor current becomes zero at a phase $\theta_2$ of the negative half cycle of the power voltage at which time the thyristor 10 is turned off. In this operation, the voltage of the nonlinear capacitor 9 is zero while the power voltage $e_{UV}$ is close to the negative peak value. Therefore, the capacitor 9 is charged through the stabilizer 6.

Figure 5:
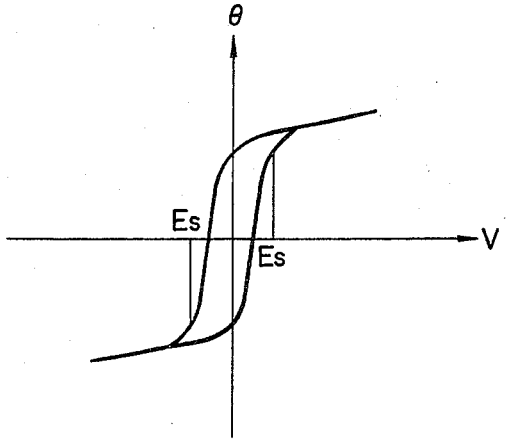
FIG. 5 is a graphical representation of a voltage vs. stored charge hysteresis curve of the nonlinear dielectric element.

The nonlinear capacitor 9 has a saturable characteristic such that the voltage V and the stored charge Q have the relation indicated in FIG. 5. Therefore, if the capacitor characteristic is so selected that it is in a nonlinear region, a region higher than the saturation voltage $E_S$ in FIG. 5, when the power voltage is lower than the peak value, then the charging current to the capacitor 9 abruptly decreases when the voltage goes into the nonlinear region. As the stabilizer 6 is an inductive element as described above, the voltage of the capacitor abruptly increases as a result of which a pulsive voltage $V_{21}$ much higher (typically of the order of 600 V) than the power voltage peak value as shown in FIG. 4A is applied to the lamp 4.

After the pulsive voltage has been generated, the supply voltage $e_{UV}$ is applied to the lamp 4 until the thyristor 10 is turned on again.

This state is maintained until the lamp 4 has been started. The filaments 5 and 5' are heated by the preheating current, while the gaseous discharge is started by the positive voltage $V_{11}$ and the negative voltage $V_{21}$. After the lamp 4 is started, the lamp voltage becomes lower than the supply voltage, and accordingly the thyristor 10 cannot be turned on. The lamp voltage increases to a level higher than the supply voltage peak value as indicated by the voltages $V_{12}$ and $V_{22}$ in FIG. 4A by the charging operation of the capacitor 9. However, the thyristor 10 is not turned on by the voltage $V_{12}$ because of the action of the smoothing capacitor 3.

As is apparent from the above description, a starter employing a nonlinear capacitor and a semiconductor switch in accordance with the invention has an excellent starting characteristic wherein a fluorescent lamp is started in about one second. Furthermore, the starter has a simple circuit arrangement and low manufacturing cost. The nonlinear capacitor can be produced using a polycrystal containing essentially $BaTiO_3$ and can be of a type manufactured by TDK Electronics Co., Ltd. (Tokyo Denkikagaku Kogyo Kabushiki Kaisha). The nonlinear capacitor can be manufactured at considerably low cost.

A suitable nonlinear capacitor has been briefly disclosed in "Journal of Electric Engineering", March 1980, page 20.

Figure 6A:
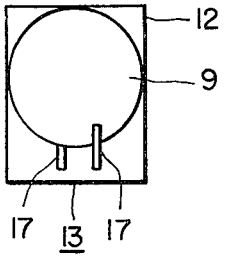
FIG. 6A is a front view and FIG. 6B is a side view of the electronic starter of FIG. 3 provided in the form of a hybrid integrated circuit.
Figure 6B:
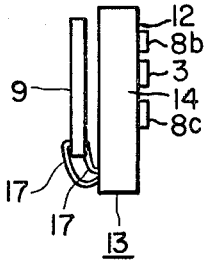

Using presently known hybrid IC techniques, all of the semiconductor devices can be provided in the form of a chip. A small chip type capacitor can be used for the capacitor 3 so long as the voltage rating is of the order of 25 V. In addition, the resistors can be provided in the form of thick films as their power ratings are smaller than 1/16 W. Accordingly, all the resistors in the above-described circuit can be provided in the form of a thick film. The lighting element 13 described above can be provided in the form of a hybrid integrated circuit as shown in FIG. 6. For instance, in the embodiment here described, the lighting element 13 includes a ceramic nonlinear capacitor 9 having an outside diameter of 14 mm and a thickness of 1 mm, lead wires 17 coupled to the capacitor 9, and a semiconductor switch 12 which is electrically connected to lead wires 17 extending from the capacitor 9. The semiconductor switch 12 includes a rectangular ceramic substrate 14 which is substantially equal in size to the capacitor 9; an SCR 10 and an SBS 11 in the form of a semiconductor chip; resistors 8*a*, 8*b* and 8*c* in the form of a thick film; and a chip type capacitor 3, all of which are provided on the substrate 14. The lighting element thus constructed is 14 mm in width, 16 mm in height and 4 mm in thickness. These dimensions are sufficiently small to achieve the object of the invention as they are much smaller than the corresponding dimensions of glow starters defined by JIC C7603 (corresponding to International Electrotechnical Commission Publication 155), namely, 18 mm $\phi\times$40 mm (E type) and 22 mm $\phi\times$38 mm (P type).

Figure 7:
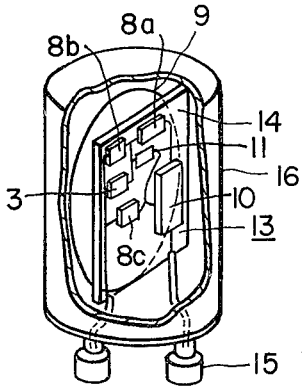
FIG. 7 is a perspective view, with a part cut away, showing a fluorescent lamp lighting device according to the invention obtained by mounting the electronic starter in the form of a hybrid integrated circuit of FIG. 6 in a glow starter case.

An example of a fluorescent lamp lighting device constructed according to the invention, as shown in FIG. 7, includes an aluminum cylindrical case 16 and connecting terminals 15 with the dimensions of the case 16 and the terminals 15 conforming to those defined by JIS C7603 (corresponding to IEC Publication 155); a ceramic substrate 14 on which thick film resistors 8*a*, 8*b* and 8*c*, a chip type capacitor 13 and semiconductor chips 2, 10 and 11 are formed; and a nonlinear capacitor 9.

As described above, the connecting terminals 15, which can be coupled electrically and mechanically to the conventional base of a glow starter as specified by JIS C7709 (IEC Publication 61) and JIS C7606 (IEC Publication 155), are coupled to the electronic starter. Accordingly, the lighting element provided by the invention can be plugged into a glow starter socket as specified, for instance, by JIS C8324 (corresponding to IEC Publication 400). Furthermore, as the electronic starter is small as shown in FIG. 6, it can be mounted in a case which is substantially the same in configuration as that specified by JIS C7603 and JIS C7709, and accordingly the starter according to the invention can be plugged into the conventional glow starter socket.

As is apparent from the above description, according to the invention, even a lighting fixture employing a conventional glow lighting system can be used without modification with the electronic starter of the invention so that it can be started substantially instantaneously. Furthermore, according to the invention, unlike the prior art, it is unnecessary to periodically replace the glow starter.

What is claimed is:

1. A flourescent lamp starting device for substantially instantaneously starting a flourescent lamp, comprising:

a ceramic substrate having components forming a semiconductor switch mounted thereon, said semiconductor switch comprising a thyristor having anode and cathode terminals coupled to first and second lead wires, respectively, a first resistor coupled between a gate electrode of said thyristor and said cathode electrode of said thyristor, second and third resistors coupled in series with one another between said anode and cathode electrodes of said thyristor, a nonlinear trigger element coupled between a common connection point of said second and third resistors and said gate electrode of said thyristor, and a capacitor coupled between said common connection point and said cathode electrode of said thyristor, said thyristor and said nonlinear trigger element comprising semiconductor chips, said first through third resistors comprising thick film resistors, and said capacitor comprising a chip-type capacitor;

a nonlinear capacitor of a size substantially equal to the size of said substrate having first and second terminals connected to said first and second leads, respectively, said nonlinear capacitor being in the form of a thin plate, and said first and second leads supporting said nonlinear capacitor in a position adjacent and parallel to said substrate;

a case substantially equal in size to a conventional glow starter case; and first and second connecting terminals mechanically coupled to said case and electrically insulated from said case, said first and second connecting terminals being adapted to be electrically and mechanically connected directly to a conventional glow starter socket, and said first and second leads being coupled to said first and second connecting terminals, respectively.

* * * * *